United States Patent [19]

Howell

[11] Patent Number: 4,656,324

[45] Date of Patent: Apr. 7, 1987

[54] CURRENT LIMITING CIRCUIT INTERRUPTER

[75] Inventor: Edward K. Howell, Simsbury, Conn.

[73] Assignee: General Electric Company, New York, N.Y.

[21] Appl. No.: 839,491

[22] Filed: Mar. 14, 1986

[51] Int. Cl.[4] ..... H01H 33/12; H01H 33/18

[52] U.S. Cl. ..... 200/146 R; 200/147 R

[58] Field of Search ..... 200/146 R, 147 R

[56] References Cited

U.S. PATENT DOCUMENTS

| | | | |
|---|---|---|---|
| 1,645,905 | 10/1927 | Gregory et al. | 200/146 R |
| 4,001,742 | 1/1977 | Jencks et al. | 335/175 |
| 4,039,983 | 8/1977 | Terracol et al. | 335/16 |
| 4,115,829 | 9/1978 | Howell | 361/42 |

FOREIGN PATENT DOCUMENTS

| | | | |
|---|---|---|---|
| 292083 | 1/1932 | Italy | 200/146 R |
| 1103746 | 2/1968 | United Kingdom . | |

OTHER PUBLICATIONS

Edward Keith Howell, "Current Limiting Circuit Breaker", Ser. No. 674,810, filed Nov. 26, 1984.

Edward Keith Howell, "High Speed Contact Driver for Circuit Interruption Device", filed 12/30/85, Ser. No. 814,865.

Edward Keith Howell, "Varistor Quenched Arc Chute for Current Limiting Circuit Interrupters", Ser. No. 839,379.

*Primary Examiner*—Robert S. Macon

*Attorney, Agent, or Firm*—Richard A. Menelly; Walter C. Bernkopf; Fred Jacob

[57] ABSTRACT

A pair of main contacts and a pair of arcing contacts are electrically and mechanically interconnected within a current limiting circuit interrupter. A common operator biases the main contacts in a closed contact condition, while simultaneously biasing the arcing contacts to an open condition. A contact driver operating to open the main contacts simultaneously closes the arcing contacts causing circuit current to pass through both the main and arcing contacts. Further displacement of the moving contacts completely directs the circuit current through the arcing contacts for electromagnetic repulsion and arcing within a magnetic structure.

10 Claims, 5 Drawing Figures

CURRENT LIMITING CIRCUIT INTERRUPTER

BACKGROUND OF THE INVENTION

The use of separate main contacts and arcing contacts within a circuit interrupting device is described within U.S. Pat. No. 4,039,983, in the names of Claude Terracol et al. and British Patent Specification No. 1,103,746, in the name of Narodni Podnik. In both the aforementioned U.S. Patent and British Patent Specification, current transfers through the main and arcing contacts until the main contacts become separated.

U.S. patent application Ser. No. 674,810, filed Nov. 26, 1984, in the name of E. K. Howell, entitled "Current Limiting Circuit Breaker", describes a high speed current limiting circuit interrupter utilizing a pair of main contacts electrically connected in parallel with a pair of arcing contacts arranged at the ends of movable contact arms. At the instant of separation of the main contacts, the circuit current transfers to the arcing contacts causing the arms to separate by electromagnetic repulsion creating an arc, which is subsequently extinguished within an arc chute.

The advantages of main and arcing contacts are described within the aforementioned U.S. patent application and include the use of a highly conductive metal for the main contacts to carry continuous current along with the use of a refractory metal for the arcing contacts. Further described within the aforementioned U.S. patent application is the expediency of arranging the arcing contacts at the ends of thin contact arms, which do not carry current on a continuing basis.

In the aforementioned current limiting circuit interrupter designs wherein the main contacts and the arcing contacts are electrically connected in parallel, relatively large currents may pass through the arcing contacts until such time as the contacts become electromagnetically repulsed and an arc ensues. The contacts and contact carrying arms must be heavy enough to sustain the large currents without becoming heated.

The instant invention provides a contact arrangement between the main and arcing contacts which assures that the arcing contacts do not become connected within the protected circuit until the main contacts have already started to separate.

SUMMARY OF THE INVENTION

A current limiting circuit interrupter wherein the main contacts for carrying continuous current within an electric circuit are arranged with respect to a pair of arcing contacts attached to the ends of elongated movable contact arms. The main contacts are electrically and mechanically biased by a common contact closing mechanism which biases the main contacts into a closed circuit condition, while holding the arcing contacts in an open circuit condition. Movement of the main contact operator simultaneously separates the main contacts while bringing the arcing contacts into the closed current carrying condition. Separation of the main contacts causes complete circuit current transfer to the arcing contacts for electromagnetic repulsion of the movable contact arms and generation of an arc between the arcing contacts. A magnetic structure enhances the rate of electromagnetic repulsion while elongating and extinguishing the arc at the instance of occurrence.

DESCRIPTION OF THE PREFERRED EMBODIMENT

Figure 1:
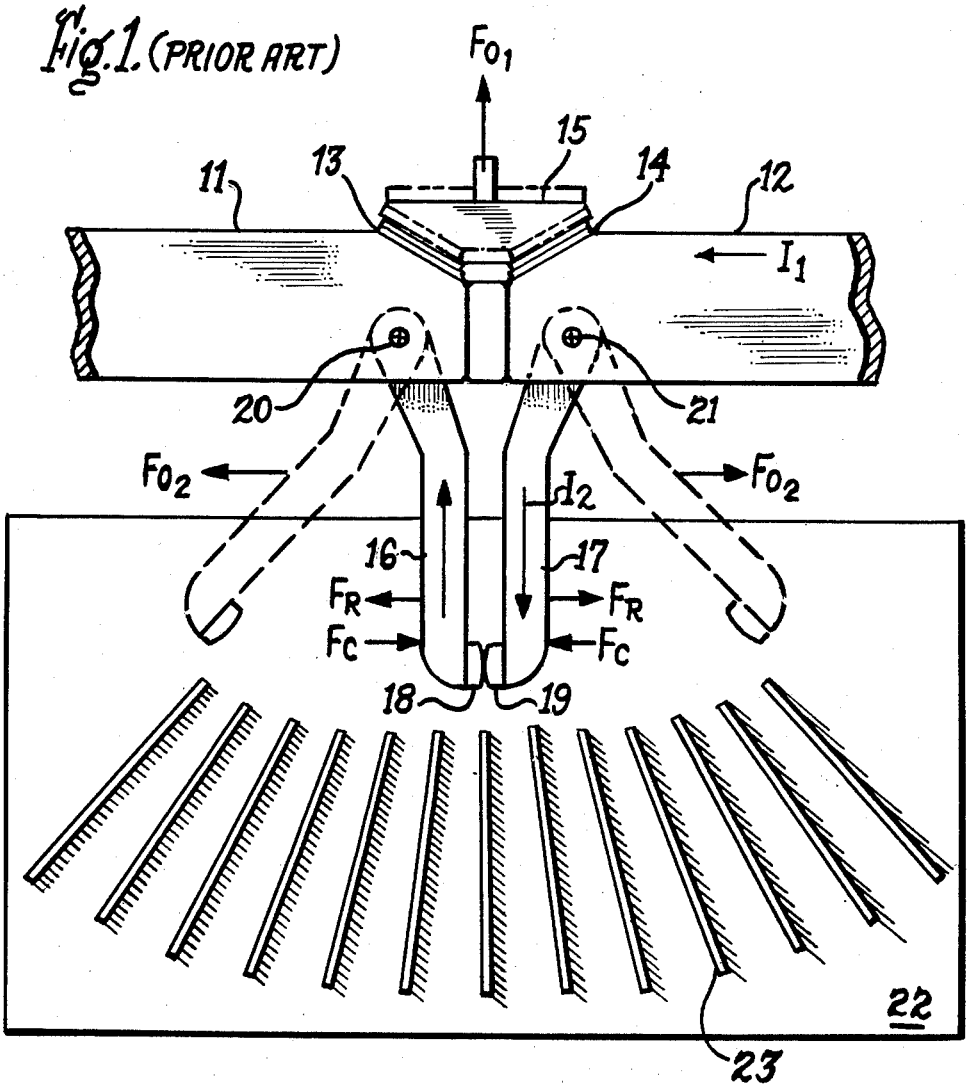
Fig. 1. (PRIOR ART)
FIG. 1 is a top view of a current limiting circuit interrupter having main and arcing contacts electrically connected in accordance with the prior art.

Before describing the current limiting circuit interrupter according to the invention, it is helpful to review the prior art contact arrangement 10 depicted in FIG. 1. The arrangement is described within the aforementioned U.S. patent application and consists of a pair of contact straps 11, 12, each containing a main contact 13, 14, across which a bridging contact 15 is arranged for moving to the open position, indicated in phantom, under the influence of a contact opening force $F_{01}$. Under normal quiescent operating conditions, circuit current $I_1$ transfers through contact strap 12, main contact 14, bridging contact 15, main contact 13 over to contact strap 11. A pair of movable contact arms 16, 17, each having an arcing contact 18, 19 at one end thereof and pivotally mounted by means of pivot pins 20, 21 at their opposite ends, is arranged electrically in parallel with the main contacts. A portion $I_2$ of the circuit current transfers from the contact strap 12 through the movable contact arm 17, arcing contacts 19, 18, movable contact arm 16 to contact strap 11. Since the main contacts 13, 14 and bridging contact 15 are made of a silver alloy having a low electrical contact resistance, most of the current will transport therethrough and only a fraction of the steady state circuit current will transport through the arcing contacts 18, 19, which are fabricated from a tungsten alloy having a much higher contact resistance. When a short circuit overload condition is sensed, an opening force $F_{01}$ is applied to the bridging contact 15 to separate the bridging contact from the main contacts 13, 14, causing arcs to occur between contacts 14, 15 and 13, 15 and diverting the circuit current through the movable contact arms 16, 17, causing them to become electromagnetically repulsed under the influence of the opening force $F_{02}$ as indicated in phantom. The arc that occurs between the arcing contacts is quickly extinguished within an arc chute 22 by means of a plurality of arc plates 23. An insulative block 9, arranged between the contact straps 11, 12, prevents the occurrence of an arc between the straps when the bridging contact is drawn away from the main contacts. In a preferred embodiment, a varistor material is used for insulative block 9 for diverting current and energy from the arc rapidly, thereby providing a current limiting action with rapid recovery of voltage. For purposes of this disclosure, the closing force on the arcing contacts comprises $F_C$ and is provided by means of contact closing springs (not shown), which must be overcome by a repulsion force $F_R$ in order to separate the contacts. Since a small fraction of the short time overload current is carried through the movable contact arms 16, 17, the contact force $F_C$ must be larger than the electromagnetic repulsion force $F_R$ created by current in the movable contact arms 16, 17 for any current magnitude below a designated "instantaneous" trip level. To ensure that these arms do not become heated prior to electrodynamic repulsion, the arms are made of a sufficiently heavy bar of copper material, which, in turn, adds to the forces required to separate the arms during electromagnetic repulsion. It has since been determined that the movable contact arms can be substantially reduced in size for more rapid circuit interruption by the contact arrangement within the current limiting circuit interrupter 43 depicted in FIG. 2, which is the subject of the instant invention.

Figure 2:
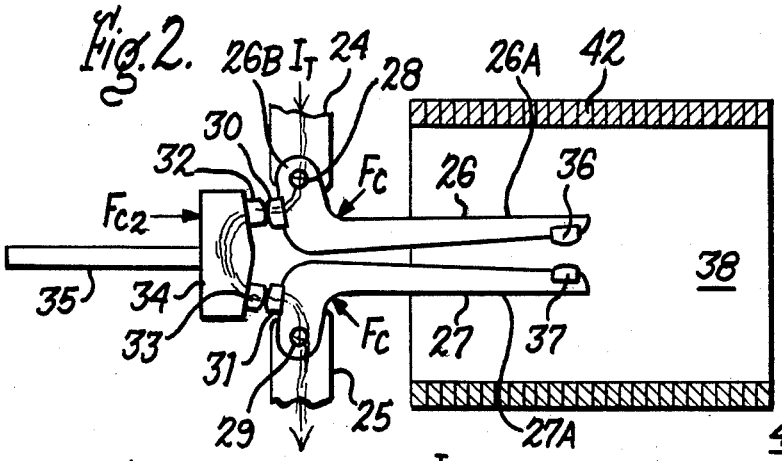
FIG. 2 is a top view of a current limiting circuit interrupter according to the invention.
Figure 2A:
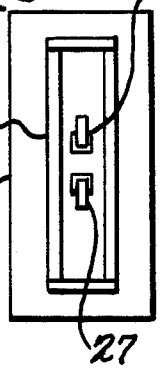
FIG. 2A is an end view of the current limiting circuit interrupter of FIG. 2.

The current limiting circuit interrupter 43, shown in FIG. 2, comprises a pair of contact straps 24, 25 to which are attached a pair of L-shaped movable contact arms 26, 27 by means of a pair of pivot pins 28, 29. The L-shaped contact arm 26 consists of a first thin major leg 26A and a first thick minor leg 26B at right angles thereto with a similar second thin major leg 27A and a second thick minor leg 27B for the other L-shaped contact arm 27. The thick minor legs 26B, 27B each contain a main contact 30, 31 attached thereto for electrical connection with a pair of bridging contacts 32, 33 arranged on a bridging contact carrier 34. The main and bridging contacts comprise a silver alloy to minimize the contact resistance when the circuit current $I_T$ passes through these contacts, as indicated. The thick minor legs 26B, 27B ensure that steady state quiescent current does not cause these minor legs to become heated. The bridging contact carrier 34 is operatively connected by means of an operating rod 35 to an operating mechanism which, although not shown, is similar to that described within U.S. Pat. No. 4,001,742, which patent is incorporated herein for reference purposes. A current sensing device comprising a current transformer and an electronic sensing circuit as described within U.S. Pat. No. 4,115,829, is used with the operating mechanism. This patent is also incorporated herein for purposes of reference. Besides the standard operating mechanism described, for example, in aforementioned U.S. Pat. No. 4,001,742, a fast acting contact operator, such as described in U.S. patent application Ser. No. 814,865, filed Dec. 30, 1985, in the name of E. K. Howell and entitled "High Speed Contact Driver For Circuit Interruption Device" can also be employed for rapidly separating the bridging contact carrier and the attached bridging contacts where high speed circuit interruption is desired. The arcing contacts 36, 37 each comprise a tungsten alloy for exhibiting erosion resistance to the arc that forms therebetween when these contacts are separated under overload current conditions. A magnetic structure 43 encloses the L-shaped movable contact arms and comprises a plurality of slotted magnetic laminations 42 for enhancing the magnetic field, which is generated when the circuit current is caused to transfer through the L-shaped movable contact arms in opposite directions. A pair of ceramic plates 38, best seen by referring to FIG. 2A, are positioned inboard of the magnetic laminations to electrically insulate the laminations from the arc that forms upon contact separation. To cool and extinguish the arc that occurs between the arcing contacts 36, 37, an arc chute consisting of a plurality of spaced metal plates may be positioned adjacent the contacts. To assist in quenching and dissipating the arc energy, a varistor may be connected across straps 24, 25, or a plurality of varistors may be interposed between the metal plates. The use of varistors in combination with metal plates in circuit interruption devices is described in U.S. patent application Ser. No. 839,379 filed 3-14-86, entitled "Varistor Quenched Arc Chute For Current Limiting Circuit Interrupters", in the name of E. K. Howell. Still referring to FIG. 2, the current limiting circuit interrupter operates in the following manner. The bridging contact carrier 34 is positioned, by means of the contact operating mechanism, to abut main contacts 30, 32 and main contacts 31, 33 and to separate arcing contacts 36, 37. To assure good electrical connection between the main and bridging contacts 30–33 and to reduce the electrical resistance therebetween, separate contact closing springs on the minor legs 26B, 27B are indicated by the closing spring forces $F_C$ which produce a reaction force $F_{C2}$ on the contact carrier 34. By the arrangement of the main contacts on the bottom side of the minor legs, the arcing contacts 36, 37 are held in the open position so that none of the circuit current passes through the arcing contacts while the main contacts 30, 31 are connected.

Figure 3:
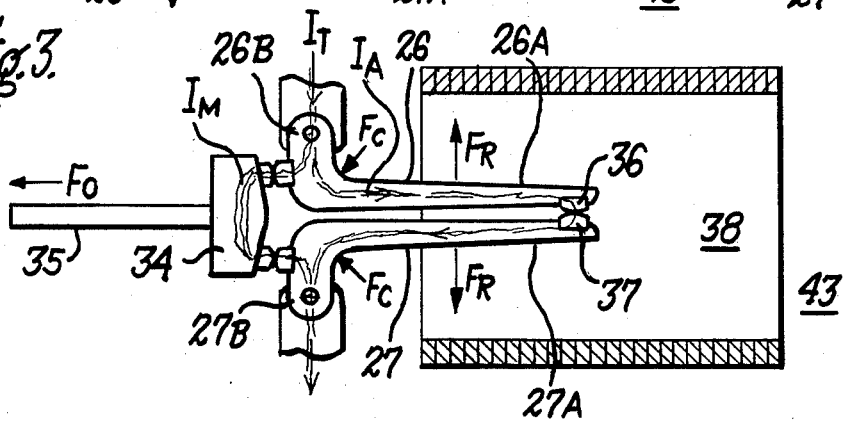
FIG. 3 is a top view of the current limiting circuit interrupter of FIG. 2 at the instant of touching of the arcing contacts.
Figure 4:
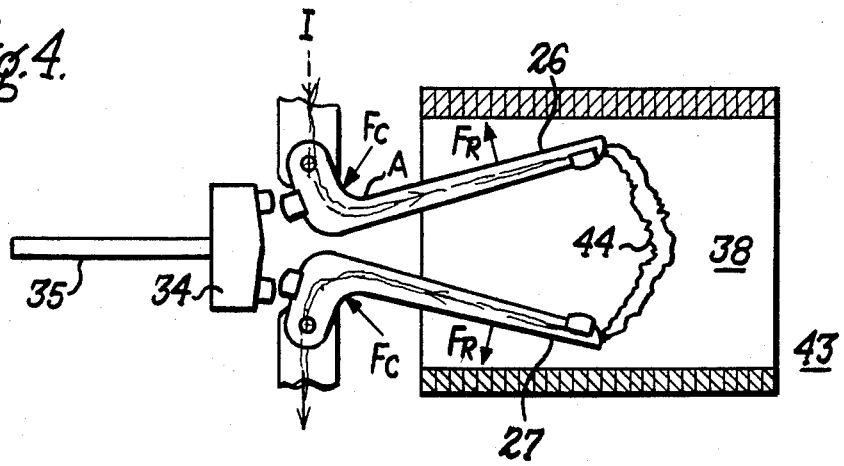
FIG. 4 is a top view of the current limiting circuit interrupter of FIG. 2 after the main contacts have completely separated and an arc has formed between the arcing contacts.

The current limiting circuit interrupter 43 is shown in FIG. 3, wherein an opening force $F_O$ is provided to the bridging contact carrier 34 in the indicated direction upon the occurrence of a predetermined current, hereafter, "interruption current". After the bridging contacts have moved a short distance, in the order of a few thousandths of an inch, the arcing contacts 36, 37 touch and the interruption current begins to transfer from the main and bridging contacts over to the arcing contacts, as indicated in FIG. 3 wherein the main contact current $I_M$ passes through the main and bridging contacts and wherein the arcing contact current $I_A$ passes through the arcing contacts. As the main contacts begin to separate, small arcs occur between the main and bridging contacts which develop a pair of arc voltages at approximately 15 volts each, producing a total arc voltage of approximately 30 volts across contact arms 26, 27. Since the arms are arranged very close together for minimum inductance between the bridging and arcing contacts, the interruption current will completely transfer to the L-shaped movable contact arms within a few microseconds even though an arc may develop between contacts 36, 37. This rapid transfer limits erosion of the main and bridging contacts and enables rapid de-ionization of the arcs that have formed therebetween for rapid voltage recovery. With the interruption current now flowing completely through the L-shaped movable contact arms, the large electromagnetic repulsion force $F_R$ rapidly repulses the arms, thereby generating an arc 44 between the separating arcing contacts, as best seen in FIG. 4. Since the arc is within the magnetic structure 43, a large electromagnetic force $F_A$ is exerted on the arc causing the arc to rapidly stretch and cool and thereby increase the arc voltage forcing the interruption current to rapidly approach zero. The use of a varistor or varistors provides a parallel conductive path as soon as the arc voltage reaches the varistor clamping voltage, causing some of the arc current to transfer through the varistors, thereby reducing the arc current. The negative resistance characteristics of the arc in parallel with the varistors causes the arc to become unstable, ultimately forcing all the arc current to transfer over to the varistors. Thus, the energy dissipated in the arc is greatly reduced by raising the arc voltage very rapidly to the varistor clamping voltage. The stored energy in the electrical system, within which the current limiting circuit interrupter is connected, is then passively dissipated in the varistors. It is noted that the contact operating means selected for moving the bridging contact carrier 34 need only be transient since the electromagnetic repulsion of the L-shaped movable contact arms correspondingly separates the main and bridging contacts. An additional mechanism is required to hold the L-shaped movable contact arms apart in the off-state and this mechanism may be released or tripped by the transient motion of the bridging contact carrier. Thus, at very low interruption currents, the mechanism would respond to separate the L-shaped contact arms instead of the electromagnetic repulsion forces.

It has thus been shown that using a double pair of bridging and main contacts to simultaneously hold apart and electrically disconnect a corresponding pair of arcing contacts, results in ideal current limiting circuit interruption. The transition of the interruption current from the main and bridging contacts over to the arcing contacts is beneficially provided by the cooperative arrangement between the operating mechanism and the interruption current.

Having thus described my invention, what I claim as new and desire to secure by Letters Patent is:

1. A current limiting circuit interrupter comprising:

a pair of movable contact arms, each having a main contact near one end and an arcing contact at an opposite end;

a bridging contact carrier having a pair of bridging contacts oppositely adjacent said main contacts; and contact bias means operatively connected with said bridging contact carrier to hold said bridging contacts and said main contacts in electrical connection while holding said arcing contacts out of electrical connection when said bridging contact carrier is in a first position and for moving said arcing contacts into electrical connection when said contact carrier is in a second position and for separating said bridging contacts from said main contacts when said contact carrier is in a third position.

2. The current limiting circuit interrupter of claim 1 wherein said contact arms comprise an L-shaped configuration having perpendicular short and long legs, said main contact being attached to said short leg and said arcing contacts being attached to said long leg.

3. The current limiting circuit interrupter of claim 2 wherein said main and said bridging contacts comprise a silver alloy and said arcing contacts comprise a tungsten alloy.

4. The current limiting circuit interrupter of claim 2 wherein both said long legs and said arcing contacts are arranged within a slotted magnetic structure for enhancing electromagnetic repulsion between said long legs when interruption current transfers between said long legs through said arcing contacts.

5. The current limiting circuit interrupter of claim 4 including an arc chute proximate said arcing contacts within said slotted magnetic structure for electromagnetically repelling an arc which forms between said arcing contacts when said long legs become separated.

6. The current limiting circuit interrupter of claim 5 wherein said arc chute comprises a plurality of aligned metal plates spaced apart from each other.

7. The current limiting circuit interrupter of claim 1 wherein a cross-section through said short legs is larger than a cross-section through said long legs.

8. The current limiting circuit interrupter of claim 2 wherein said L-shaped movable contact arms are pivotally attached to a pair of bus conductors by means of pivot pins arranged through said short legs.

9. The current limiting circuit interrupter of claim 1 wherein a varistor is connected in parallel with said movable contact arms.

10. The current limiting circuit interrupter of claim 6 wherein said metal plates include a corresponding plurality of varistor elements intermediate said metal plates for quenching and cooling said arc.

* * * * *